United States Patent [19]

Gill

[11] Patent Number: 4,794,894

[45] Date of Patent: Jan. 3, 1989

[54] CERAMIC TIPPED PIVOT ROD AND METHOD FOR ITS MANUFACTURE

[75] Inventor: Daniel E. Gill, Columbus, Ind.

[73] Assignee: Cummins Engine Company, Inc., Columbus, Ind.

[21] Appl. No.: 22,229

[22] Filed: Mar. 5, 1987

[51] Int. Cl.[4] ..... F01L 1/14

[52] U.S. Cl. ..... 123/90.61; 123/508; 29/156.7 B; 29/525; 74/579 R; 403/28; 403/282

[58] Field of Search ..... 123/90.61, 508; 74/579 R; 403/282, 284, 280, 30, 28; 29/156.7 B, 525

[56] References Cited

U.S. PATENT DOCUMENTS

| | | | |
|---|---|---|---|
| 2,897,805 | 8/1959 | Etzler | 123/90.61 |
| 3,272,190 | 9/1966 | Di Matteo, Sr. et al. | 123/90.61 |
| 4,366,785 | 1/1983 | Goloff et al. | 123/90.51 |
| 4,453,505 | 6/1984 | Holtzberg et al. | 123/90.61 |
| 4,508,067 | 4/1985 | Fuhrmann | 123/90.49 |
| 4,614,453 | 9/1986 | Tsuno et al. | 403/30 |
| 4,690,617 | 9/1987 | Oda et al. | 403/30 |

FOREIGN PATENT DOCUMENTS

| | | | |
|---|---|---|---|
| 57-13203 | 1/1982 | Japan | 123/90.61 |
| 57-13204 | 1/1982 | Japan . | |
| 742612 | 6/1980 | U.S.S.R. . | |

*Primary Examiner*—Andrew M. Dolinar

*Attorney, Agent, or Firm*—Sixbey, Friedman, Leedom & Ferguson

[57] ABSTRACT

A pivot rod, such as a push rod of the type found included in fuel injector drive trains and engine cylinder valve drive trains, has a mounting shaft with an interior receiving space at at least one end thereof, and a pivot insert formed of a ceramic material that is positioned with a first portion thereof disposed within the receiving space of the mounting shaft and a second portion thereof projecting axially beyond the end of the mounting shaft. To avoid tensile "hoop" stresses from exceeding the maximum tensile principle stress of the ceramic material of the pivot insert, despite the use of an interference fit securement between the pivot insert and the mounting shaft, and despite variations in the degree of diametral interference existing between the internal diameter of the receiving space and the external diameter of the inserted pivot insert portion resulting from manufacturing tolerances, the wall of the pivot shaft taking part in the interference fit securement has its thickness and material composition coordinated with the maximum tensile principle stress so that the wall is plastically deformed by the pivot insert during formation of the interference fit securement. When an axially projecting portion of the pivot insert has an abutment surface in abutting engagement upon an end surface of the mounting shaft, the axial length of the interference fit securement between the pivot insert and mounting shaft is also coordinated to the maximum tensile principle stress of the ceramic material.

9 Claims, 5 Drawing Sheets

PRINCIPLE TENSILE STRESS
DIAMETRAL INTERFERENCE
POINT B
2
A (W/O PLASTICITY)
1
SM
SMP
POINT A (W/PLASTICITY)
3
I
A
B
R

CERAMIC TIPPED PIVOT ROD AND METHOD FOR ITS MANUFACTURE

TECHNICAL FIELD

The present invention relates to pivot rods, such as push rods of the type found included in fuel injector valve drive trains and engine cylinder valve drive trains.

BACKGROUND ART

It has been conventional for a long time to produce pivot rods, such as the push rods that are utilized for operating the injection piston of a fuel injector or the cylinder valves of an engine of a construction having a tubular shaft into the ends of which pivot contact members constructed of a hardened material are plugged. An example of such a known push rod may be found in the DiMatteo, et al. U.S. Pat. No. 3,272,190. However, the high compressive loads imposed between, e.g., the ball and the socket components of pivot rods of such engine sub-system drive trains can result (within as little as 20,000 to 30,000 miles) in even hardened metallic surfaces of a ball and/or socket becoming worn to such an extent that undesirably large amounts of play occur which adversely impact upon the operation of the associated fuel injectors, valves, etc. Such wear is most common with either lower quality lubricating oils or with even good quality lubricating oil in which anti-wear additives have become depleted during the course of its use in an engine. Thus, when such wear occurs, it is necessary to perform major servicing of the engine and the vehicle equipped with the associated engine must be taken out of use for a day or more.

It has also been found that the use of ceramic components can produce a dramatic reduction in wear to such an extent that, even with a metal socket-ceramic ball combination, a life of as much as 500,000 miles can be expected before unacceptably large wear will have resulted (i.e., an increase of as much as 20 times the life of prior art metal-to-metal ball and socket joints). Thus, a definite advantage can be achieved if the pivot insert plugs for push rods and the like are made of a wear resisting ceramic material. On the other hand, a difficult problem exists in the design of ceramic tipped push rods concerning the attachment of the ceramic (i.e., silicon nitride, silicon carbide, zirconia, etc.) to the end of the tube.

When joining a metal plug to a metal tube, a "press fit" has normally been used as the means for attaching the plug inserts to the tube since that is the simplest and most economical method of attaching such parts. However, the problem that arises when doing this with ceramic end pieces is that the press fit induces a tensile "hoop" stress in the ceramic part which is directly proportional to the amount of "press" used to hold the ceramic end pieces. In metals, this is usually no great problem because of the ductility of the metal, but with ceramics too much tensile stress leads to possible fracturing of the ceramic piece. This fracture problem is compounded by the uncertainty in the "failure" criteria for such ceramic materials. While the amount of "press" can be controlled directly by strict tolerancing of the parts involved, this has been tried with the result that the "required" tolerances were not only uneconomically small, but were also unproducible with today's technology.

U.S. Pat. No. 4,508,067 to Fuhrmann discloses a tappet and a cam contact member therefor wherein a shaft-like solid tappet body made of, for example, cast iron, has an end socket in which a cam contact member made of a brittle, hard ceramic-based material is held by soldering or glueing. In order to reduce high-Hertz (contact) stresses, the contact surface is given a spherical surface having dimensioning that is determined in accordance with a special formula utilizing the maximum contact force expected between the expected between the cam contacting surface and cam, the Young's modulus of the material of the cam contacting surface, and the Poissons' ratio of the material of the cam contacting surface. Furthermore, the rear surface of the cam contacting member is flat and a concavity is provided between this rear surface and the bottom wall of the socket of the solid tappet body within which it is held so that the flat surface on the cam contact member opposite the cam engaging surface will always deflect toward the cavity during operation for reducing the contact stresses and wear associated therewith. However, numerous deficiencies exist in such a design. Firstly, it is hard to obtain a sufficient bond between a ceramic insert and a metallic body member by soldering or glueing. Furthermore, when soldering is used, adverse temperature effects are possible. Also, the precision machining associated with producing this type of contact member renders it considerably more expensive than a typical press fit mount, while the bending stresses associated with a design wherein a ceramic piece is "always" deflecting on contact could cause damage to the ceramic insert which is formed of an essentially brittle material.

A tappet with a wear resisting insert is also disclosed in Goloff, et al. U.S. Pat. No. 4,366,785. In this patent, the body of the tappet is a cylindrical piece formed, for example, of cast iron, steel, or the like, to which a disc-shaped wear resisting insert of a ceramic material is mounted within a complementary shaped recess in the end of the tappet body by way of an interference or press fit. By making the ceramic wear resisting insert of a disc shape with a flat, outer contact surface, and having this wear resisting insert fully received within the end recess of the tappet body, hoop stress problems are avoided, there being no tensile stress loading of the ceramic insert (tensile loading being the "Achilles heel" of ceramic materials, which are highly resistant to compressive loading). However, such a design has the disadvantage that it precludes the use of simple tube stock as a mounting shaft for a pivot insert, requiring instead a body member having a conforming recess with a bottom wall, which must be produced by the casting or machining. Moreover, the design of this patent is of limited applicability, since it cannot be used for attaching a wear resisting plug or insert in a manner which will result in the plug or insert being subjected to tensile hoop stresses, not merely compressive hoop stresses, e.g., where the insert projects axially beyond the end of the mounting shaft.

DISCLOSURE OF THE INVENTION

In view of the foregoing, it is an object of the present invention to provide a pivot rod, such as a push tube of the type used in engine drive trains for operating fuel injectors and cylinder valves, wherein a ceramic pivot insert may be attached to a mounting shaft by an interference fit securement without exceeding the maximum tensile principle stress of the ceramic material, either during assembly or during use, despite the fact that the insert projects axially beyond the end of the mounting shaft and despite manufacturing tolerances of the mounting shaft and pivot insert.

It is a further object of the present invention to enable the mounting shaft to be formed from either standard hollow tube stock or from specially manufactured pieces produced by casting or from solid rod stock.

It is yet another object of the present invention to enable the ceramic insert to be provided with either convexly shaped or concavely shaped contact surfaces.

A further object of the present invention s to enable the ceramic insert, in its projecting portion, to have an abutment surface in abutting engagement upon an end surface of the peripheral wall for limiting the extent to which the insert is inserted into the interior of the mounting shaft, as well as to provide a means, in addition to the interference fit, for facilitating the direct transference of load from the contact surface of the ceramic insert to the mounting shaft.

Still another object of the present invention is to provide a method of manufacturing a pivot rod which will achieve the above set forth objects.

It is a specific object of the present invention to provide a method of manufacturing a pivot rod with a pivot insert of a ceramic material wherein the thickness and material composition of a peripheral wall of the mounting shaft that circumscribes a receiving space for the ceramic pivot insert is coordinated to the maximum tensile principle stress of the ceramic material so that the peripheral wall will plastically deform under a stress below the maximum tensile principle stress of the ceramic material, whereby securement of the pivot insert to the peripheral wall of the mounting shaft by an interference fit will not exceed the maximum tensile principle stress of the ceramic material, despite variations in the degree of diametral interference existing between the peripheral wall and insert part, due to plastic deformation of the peripheral wall during formation of the interference fit.

These and other objects in accordance with the present invention are achieved, in accordance with preferred embodiments of the present invention which take advantage of relationships between principle tensile stress and diametral interference that have been determined during development of this invention and which are explainable with reference to FIG. 1. FIG. 1 represents a schematic representation of the principle tensile stresses occurring, with varying amounts of press fit, at two regions, A,B, of high tensile stress, each of which is caused by different aspects of the loading/assembly conditions existing for a pivot rod having a pivot insert I secured within a receiving space of a mounting shaft R, with a portion of the pivot insert I extending axially beyond the end of the mounting shaft R and having a portion with an abutment surface in abutting engagement upon an end surface of a peripheral wall of the shaft R. The stresses at point A are the result of assembly forces, i.e., the pressure produced by the press fit, while the stresses at point B are the result of axial load transfer from the insert I to the edge of the mounting shaft R.

As can be seen from FIG. 1, when a press fit securement of insert I to shaft R is produced without plastic deformation, as represented by dotted line 1, the stresses at point A increase as the amount of diametral interference is increased. On the other hand, as can be seen from dotted line 2, the stresses at point B decrease dramatically with increasing diametral interference. This is a result of the fact that curve 2 represents the effect of the diametral interference upon the force transfer between the insert I and the mounting shaft R, which, at large interferences, occurs mostly via friction along the press fit interface; while, at small interferences, there is less frictional load transfer and more force is transferred from the insert I to the mounting shaft R at the abutment interface at the end of the shaft R. Thus, an optimum diametral interference value occurs at the circled point $S_M$ where curves 1 and 2 intersect. However, for a ceramic material such as silicon nitride, the interference required to prevent exceeding of its tensile stress limit is uneconomically small, i.e., the cost of precision machining a material like silicon nitride, that is very hard to machine with sufficiently small tolerances, is too high.

Solid line 3 represents the curve of the assembly stresses occuring at point A when the peripheral wall defining the receiving space of shaft R is caused to plastically deform during the press fit securement of the pivot insert thereto. As can be seen from curve 3, the principle tensile stress approaches some limiting value as the diametral interference is increased without limit. As a result, it has been found that, if the plasticity effects are incorporated into the design, the diametral interference can be selected without regard to the maximum stress of the ceramic material used for the pivot insert I.

For example, with reference to FIG. 1, it can be seen that the X-ed point of intersection $S_{MP}$, representing the optimum stress level achievable based upon the curves for the stresses at point A with plasticity and point B (which is the same with or without plastic deformation of the mounting shaft during assembly), is considerably lower than optimum stress $S_M$ obtained without plasticity and it is achieved a larger diametral interference. Moreover, it can be seen that, even with doubling of the diametral interference, a principle tensile strength level will be achieved that is well below the optimum value $s_m$. Thus, precision machining of the difficult to machine ceramic part can be eliminated by choosing a value of diametral interference that is sufficiently greater than that for point $S_{MP}$ so that, even with easily obtainable manufacturing tolerances, the maximum tensile principle stress of the ceramic material will not be exceeded.

These and other characteristics, features and benefits of the present invention will become more apparent from the following detailed description and accompanying drawings.

BEST MODE FOR CARRYING OUT THE INVENTION

Figure 2:
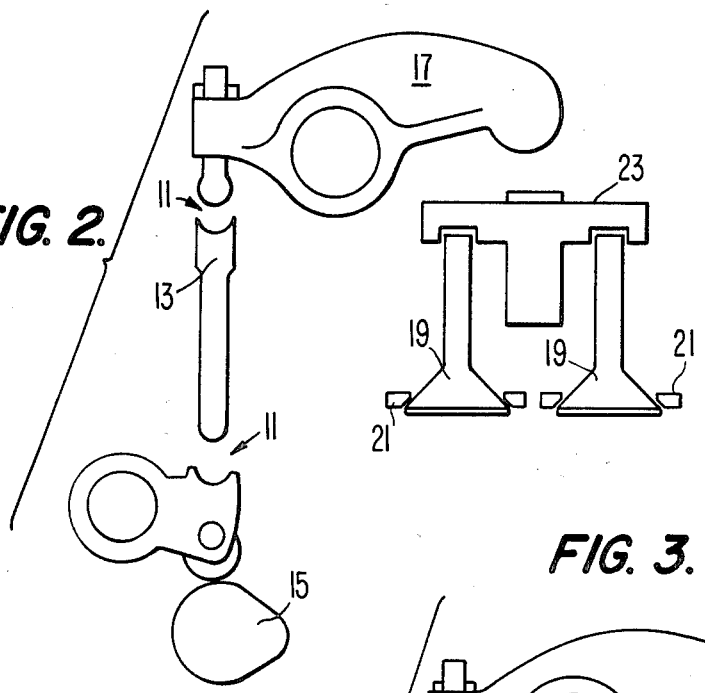
FIGS. 2 and 3 are schematic representations, respectively, of a cylinder head valve and fuel injector drive train incorporating a pivot rod in accordance with the present invention.
Figure 3:
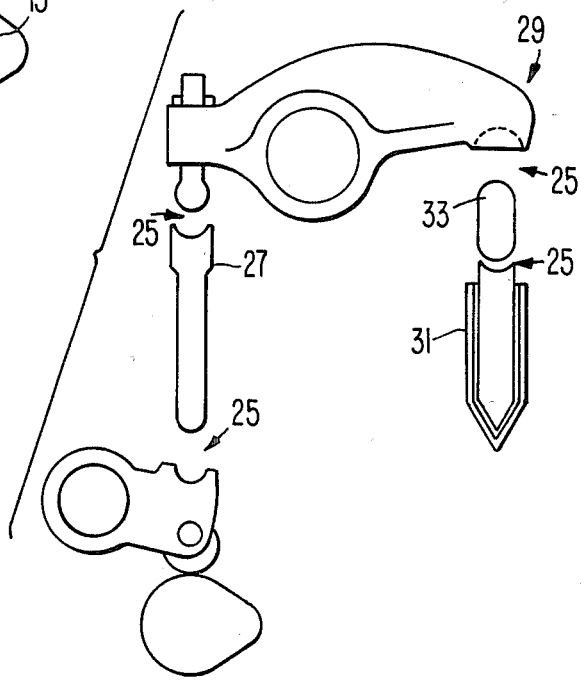
Figure 4:
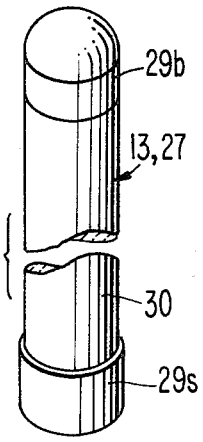
FIG. 4 is a perspective view of a pivot rod in accordance with an embodiment of the present invention for use in either of the FIG. 2 or FIG. 3 drive trains.

It has been found that in a drive train of the type schematically indicated in either FIG. 2 or FIG. 3, by way of example, ceramic ball and socket joints can increase the compressive loads to which such joints may be subjected and, even when only one of the ball and socket parts is formed of a ceramic material, the life of the joint achievable before an unacceptably large amount of wear occurs in lubricating oil of degraded quality can be increased by over an order of magnitude to, for example, 500,000 miles. In this regard, it is noted that FIG. 2 depicts an engine cylinder head valve drive train wherein ball and socket joints 11 are provided at each of opposite ends of the push rod 13 used to transmit movement produced by a cam 15 to a valve rocker lever 17, the lever 17 being used to seat and unseat valves 19 with respect to the valve seat inserts 21 via the cross head 23.

FIG. 3, on the other hand, depicts a fuel injector drive train having four ball and socket joints 25. The first pair of joints 25 are disposed at opposite ends of a push rod 27 in a manner similar to that for push rod 13 of the arrangement of FIG. 2. On the other hand, motion is transmitted from the injector rocker lever 29 to the injector piston 31 through the intermediary of a modified push rod 33 which forms the ball part for a pair of ball and socket joints 25 at each of opposite ends thereof.

It is noted that, while the present invention finds particular utility in drive trains of the type shown in FIGS. 2 and 3 (wherein high loads are experienced, servicing of the ball and socket joints is costly and time consuming, and the required frequency of servicing can be an important factor in the purchase of an engine for a vehicle or piece of equipment of which it is a part), the inventive pivot rod will also find utility in numerous other environments which have similar requirements. Furthermore, while the push rods 13,27 are comprised of a ball pivot insert *29b* and a socket insert *29s* which are secured to opposite ends of a mounting shaft 30, it should be appreciated that, depending upon the application, a pivot rod in accordance with the present invention may have two ball pivot inserts *29b* (such as for part 33 of FIG. 3), two socket parts *29s*, or only a single pivot insert *29b*, *29s* secured to only one end of the mounting shaft 30.

In accordance with one embodiment (that of FIGS. 5 and 6), the mounting shaft is formed of "off the shelf" tubing such as MT 1020, 1021 steel tubing of a standard size, tolerances, and wall thickness as specified in ASTM A-513, while in another embodiment (FIG. 7) the mounting shaft 30' is formed from a piece of standard rod stock, or may be a cast piece. In the former case, the through hole of the tubing forms an interior receiving space 33 for receiving a first, stem, portion 35 of the pivot insert *29b* or *29s*, while in the latter case the receiving space is a recess 35 that is formed into the end portion of mounting shaft 30' by machining in the case of rod stock and molding in the case of a cast piece.

Figure 1:
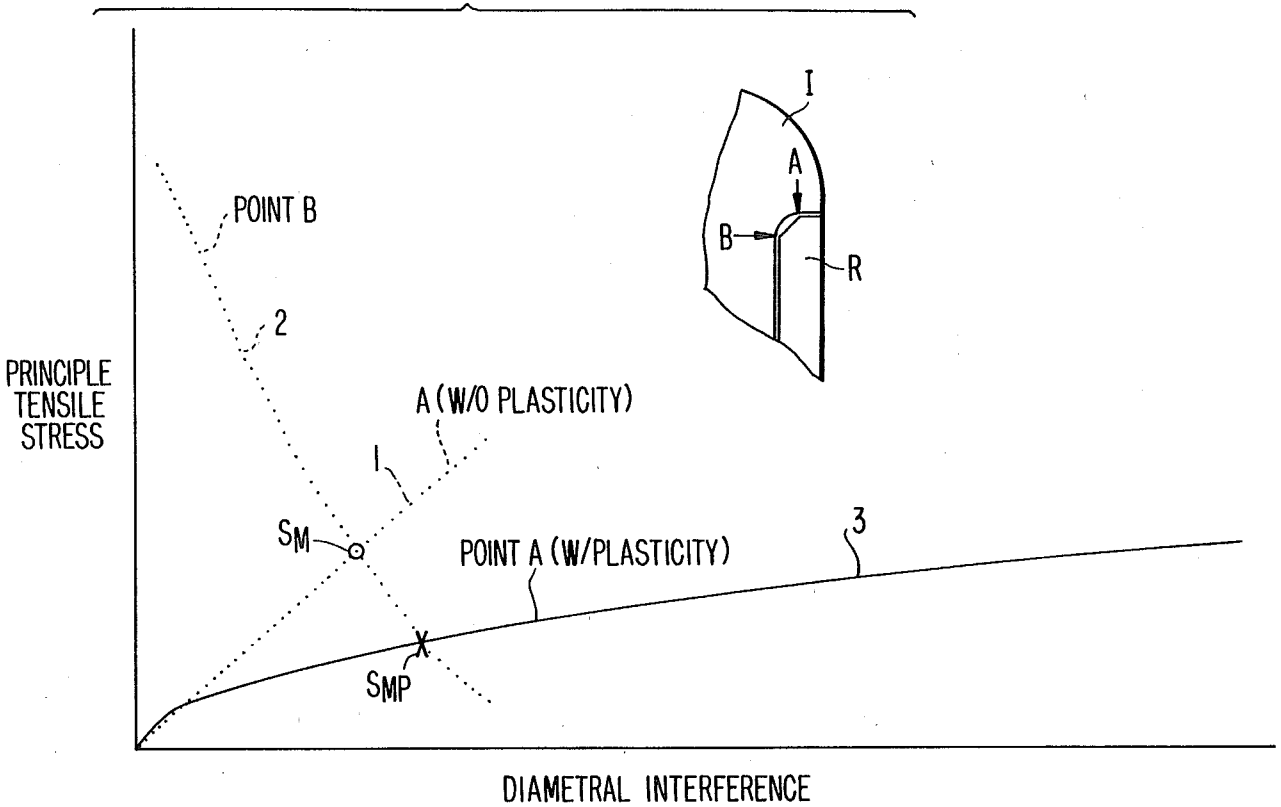
FIG. 1 is a schematic representation of principle tensile stress in a ceramic pivot insert with varying amounts of press fit.

To facilitate the press fit interconnection of the stem part 37 within the receiving space 33, 35, the inserting end of stem part 37 is provided with a chamfering 39 and the rim of the receiving space 33, 35 is provided with a chamfering 41. Furthermore, in accordance with the present invention, the thickness t of the peripheral wall circumscribing the receiving space 33 or 35 and the material composition thereof is coordinated to the maximum tensile principle stress (i.e., the maximum tensile stress allowable without causing material failure) of the ceramic material of which the insert part *29b* or *29s* is formed, so that the peripheral wall will be plastically deformed by the first portion 37 of the pivot insert during formation of the interference fit securement, as reflected, in exaggerated form, in FIG. 6. In this manner, as described above in detail with reference to FIG. 1, the interference fit securement is constructed as a means for preventing the maximum tensile principle stress of the ceramic material from being exceeded, despite variations in the degree of diametral interference existing between the internal diameter $D_i$ of the receiving space 33, 35 and the external diameter $D_o$ of the stem portion of the pivot insert resulting from manufacturing tolerances of the mounting shaft and pivot insert. That is, by insuring that the peripheral wall will deform at a loading that is less than the maximum principle stress of the ceramic material of the pivot part, a diametral interference can be produced that, even with maximum tolerance variations, will result in a tensile principle stress level being produced in the pivot insert that is below its maximum tensile principle stress for both assembly of the pivot rod and operational loading thereof.

As can also be seen from the drawings, the pivot inserts *29s* and *29b* also have a second portion 43 which projects axially beyond the end of the mounting shaft 30, 30' after securement of the pivot insert to the mounting shaft. In the case of an embodiment, such as that of FIG. 7, when the length $L_S$ of the stem portion 37 is greater than the length $L_R$ of the wall surrounding the receiving space 35, the end surface 45 of mounting shaft 30' will not engage the facing surface 47 of the pivot insert. Under such circumstances, it is sufficient that the above-described factors be coordinated.

Figure 5:
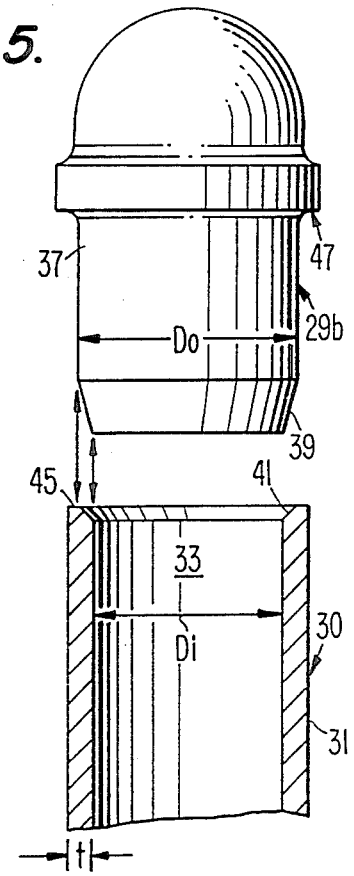
FIGS. 5 and 6 are views of a pivot rod using a hollow tubular mounting shaft just prior to and after mounting of the pivot insert, respectively, the mounting shaft being shown in cross-section.
Figure 6:
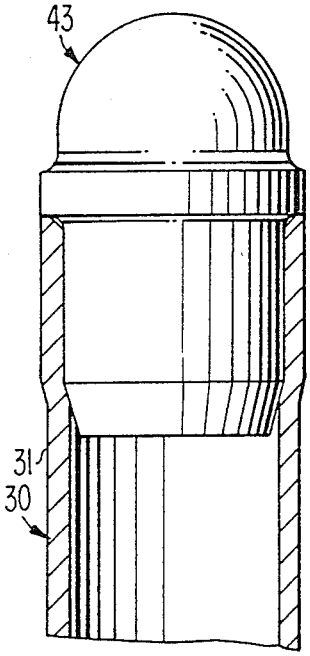
Figure 7:
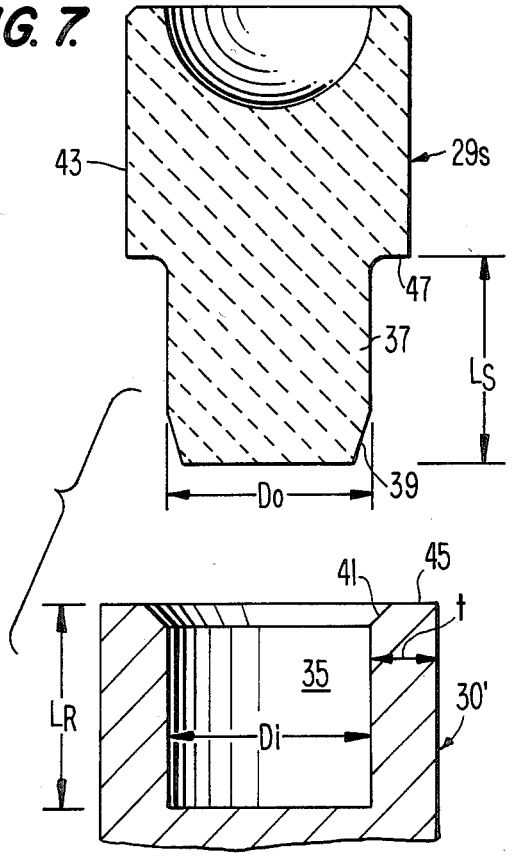
FIG. 7 is a cross-sectional view of a pivot rod in accordance with the present invention, just prior to assembly, wherein the mounting shaft has a socket formed into its end.

On the other hand, in the case of the FIG. 5, 6 embodiment or the embodiment of FIG. 7, wherein the length $L_S$ is less than the length $L_R$, the surface 47 will act as an abutment surface which abuttingly engages upon the end surface 45 of the mounting shaft 30, 30' and thus serves to limit the extent to which the first portion 37 is inserted into the interior receiving space 33, 35 and provides a means, in addition to the frictional effects of the interference fit, by which loading may be transferred from the pivot insert *29b*, *29s*, to the mounting shaft 30, 30'. In such a case, it is necessary that the axial length of the stem that is in interference fit securement with the peripheral wall of the mounting shaft also be coordinated to the maximum tensile principle stress for the ceramic material of which the pivot insert is formed.

Figure 8:
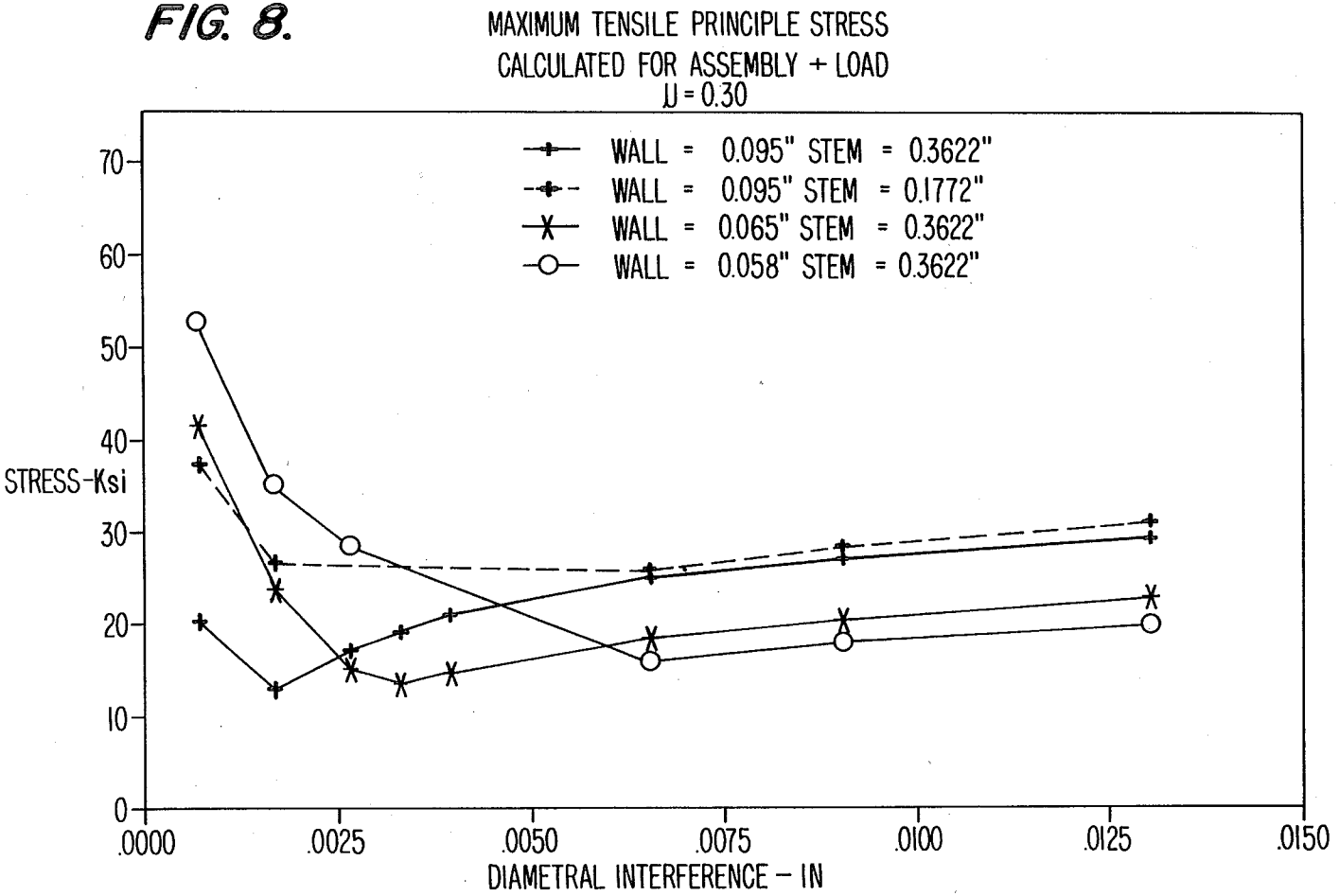
FIG. 8 is a schematic representation of maximum tensile principle stress curves illustrating the effect of wall thickness and the axial length of the interference fit.

In order to provide a more specific illustration as to how the interference fit concepts of the present invention may be applied in a specific case, reference will now be made to FIG. 8. In FIG. 8, maximum principle stress curves have been calculated for a variety of different "off the shelf" tubes 31 to which a silicon nitride pivot insert *29b* or *29s* is joined by an interference fit securement in accordance with the present invention (for the calculations the coefficient of friction has been treated as a constant equal to 0.30).

As can be seen from a comparison of the curves for the 0.095 inch wall thickness tubing, if a value of 25,000 ksi, + or −5,000 ksi, is utilized for the maximum allowable tensile stress value of the silicon nitride pivot insert, decreasing the length of the stem that is interference fit has the effect of raising the minimum stress. This occurs because less of the loading is borne by the interference fit and more loading is transferred between the abuttingly engaged surfaces 45, 47. In the specific cases illustrated, reduction of the stem length from 0.3622" to 0.1772" has rendered the interference fit securement unsuitable because it cannot be assured that the maximum tensile stress for the silicon nitride insert part will not be exceeded.

Comparing now the three curves for interference fit securements having a stem length of 0.3622 inches, it can be seen that reducing the wall thickness from 0.095 inches to 0.065 inches produces curves having approximately the same minimum stress level, but the thinner, 0.065 inch, tube achieves this minimum at a greater diametral interference value and for diametral interferences greater than that at which the minimum stress level point is produced, the stress levels remain significantly lower than those for the case where the 0.095 inch wall thickness tubing is used.

On the other hand, when the curve for the 0.065 inch wall thickness tubing is compared with that of the 0.058 inch wall thickness tubing, it can be seen that, once again, the change has resulted in an increase of the diametral interference necessary to produce the minimum stress level without there being a significant change in the minimum stress level. However, unlike the situation relative to the 0.095 inch wall thickness tubing, no dramatic decrease in stress levels occurs between the curves for the 0.065 inch and 0.058 inch wall thickness tubings in the curve portions representing diametral interferences that are larger than that at which the minimum stress level is achieved and all such values are within the 25,000 ksi, + or −5,000 allowable maximum stress values for the silicon nitride pivot insert. Since small interferences are more costly and difficult to produce than large diametral interferences, from a practical standpoint both the 0.058 inch and 0.065 inch wall thickness tubings may be considered equally suitable for use in achieving an interference fit securement, in accordance with the present invention, for this example. It is also pointed out that a diametral interference would be aimed for which would be sufficiently to the right of the minimum stress level points shown on the curves of FIG. 8 so that, even if the maximum manufacturing tolerance variations occur in terms of a plus tolerancing of the diameter $D_i$ and a minus tolerancing of the diameter $D_O$, a diametral interference will not occur that is unsuitably to the left of the minimum stress level points of these curves shown in FIG. 8.

A pivot rod produced in accordance with the foregoing has been found to have a significantly increased wear life, and the method used for its manufacture achieves a significant simplification in the production process and thus renders it less costly. Furthermore, by sizing the wall thickness of the mounting shaft so that it will yield at a pressure such that the induced tensile "hoop" stress in the ceramic is less than the critical (failure) value, the possibility of tensile failure of the ceramic pivot insert can be avoided, not only during use, but also under the high stress loading occurring during the press fit assembly operation.

INDUSTRIAL APPLICABILITY

The present invention finds particular utility in cylinder head valve and fuel injector drive train components for engines, such as diesel engines, but will also find utility in any environment where it is necessary or desirable to use a ceramic ball and/or socket component due to the high compressive stresses to which the part will be subjected and/or where the value of a dramatically increased wear-free life outweighs the costs associated with using ceramic materials that are more expensive than the metals which are conventionally utilized.

I claim:

1. A pivot rod comprising:

(A) a mounting shaft having an interior receiving space at at least one end thereof;

(b) a pivot insert formed of a ceramic material having a maximum tensile principle stress, said pivot insert being positioned with a first portion thereof disposed within said receiving space and a second portion thereof projecting axially beyond said end of the mounting shaft;

(C) an interference fit securement between said first portion of the pivot insert and a peripheral wall of said mounting shaft circumscribing said receiving space, said interference fit securement being constructed as a means for preventing the maximum tensile principle stress of the ceramic material from being exceeded, despite variations in the degree of diametral interference existing between an internal diameter of the peripheral wall circumscribing said receiving space and an external diameter of said first portion of the pivot insert resulting from manufacturing tolerances of the mounting shaft and pivot insert, via said peripheral wall having been plastically deformed by said first portion of the pivot insert during formation of said interference fit securement through coordination of the thickness and material composition of said peripheral wall with said maximum tensile principle stress.

2. A pivot rod according to claim 1, wherein said second portion of the pivot insert has an abutment surface in abutting engagement upon an end surface of the peripheral wall for limiting the extent to which said first portion is inserted into said interior receiving space, and wherein said means for preventing also includes the axial length of the interference fit securement between said first portion and said peripheral wall being coordinated to said maximum tensile principle stress.

3. A pivot rod according to claim 2, wherein said mounting shaft is a hollow tube, and said receiving space extends the length of the tube.

4. A pivot rod according to claim 1, wherein said receiving space is a recess formed into said end of the shaft and wherein said recess has a bottom wall against which a base end of said first portion of the pivot insert is seated.

5. A pivot rod according to claim 1, wherein said pivot insert has a convexly shaped contact surface on said second portion

6. A pivot rod according to claim 1, wherein said pivot insert has a concavely shaped contact surface in said second portion.

7. A pivot rod according to claim 1, wherein a said pivot insert is mounted to each of opposite ends of the mounting shaft by a said interference fit securement.

8. A method of manufacturing a pivot rod having a mounting shaft and a pivot insert of a ceramic material, with a given maximum tensile principle stress, said pivot insert being positioned with a first portion thereof disposed within a receiving space at an end of the mounting shaft and a second portion of the pivot insert projecting axially beyond said end, comprising the steps of:

(A) coordinating the thickness and material composition of a peripheral wall of the mounting shaft that circumscribes the receiving space with the maximum tensile principle stress of the ceramic material so that said peripheral wall will plastically deform under a stress below said maximum tensile principle stress;

(B) securing said first portion of the pivot insert to said peripheral wall of the mounting shaft by an interference fit without exceeding the maximum tensile principle stress of the ceramic material, despite variations in the degree of diametral interference existing between an internal diameter of the peripheral wall and an external diameter of said first portion resulting from manaufacturing tolerances of the mounting shaft and pivot insert, by producing plastic deformation of said peripheral wall by said first portion of the pivot insert during formation of said interference fit.

9. A method according to claim 8, wherein said second portion of the pivot insert has an abutment surface which is brought into abutting engagement with an end surface of the peripheral wall during said securing step, and wherein said coordinating step includes coordinating the axial length of the interference fit to be produced in the securing step to said maximum tensile principle stress along with the thickness and material composition of the peripheral wall.

* * * * *